United States Patent [19]

Eheim, deceased et al.

[11] Patent Number: 4,854,289

[45] Date of Patent: Aug. 8, 1989

[54] FUEL INJECTION PUMP FOR INTERNAL COMBUSTION ENGINES

[75] Inventors: Franz Eheim, deceased, late of Stuttgart, Fed. Rep. of Germany, by Helga Eheim, heir; Gerald Hofer, Bad Aibling, Fed. Rep. of Germany

[73] Assignee: Robert Bosch GmbH, Stuttgart, Fed. Rep. of Germany

[21] Appl. No.: 130,701

[22] Filed: Dec. 8, 1987

[30] Foreign Application Priority Data

Dec. 27, 1986 [DE] Fed. Rep. of Germany ..... 3644584

[51] Int. Cl.[4] ..... F02M 39/00

[52] U.S. Cl. ..... 123/503; 123/449

[58] Field of Search ..... 123/449, 501, 373, 503

[56] References Cited

U.S. PATENT DOCUMENTS

| | | | |
|---|---|---|---|
| 3,758,241 | 9/1979 | Eheim | 123/503 |
| 4,220,128 | 9/1980 | Kobayashi | 123/449 |
| 4,506,545 | 3/1985 | Yamada | 123/503 |
| 4,530,330 | 7/1985 | Sakuranaka | 123/503 |
| 4,561,398 | 12/1985 | Roca Nierga | 123/503 |
| 4,587,940 | 5/1986 | Schmid | 123/503 |
| 4,721,442 | 1/1988 | Tanaka | 123/503 |
| 4,763,631 | 8/1988 | Fehlmann | 123/503 |

FOREIGN PATENT DOCUMENTS

| | | | |
|---|---|---|---|
| 3218275 | 12/1982 | Fed. Rep. of Germany | 123/449 |
| 0126828 | 10/1979 | Japan | 123/503 |

*Primary Examiner*—Carl Stuart Miller

*Attorney, Agent, or Firm*—Edwin E. Greigg

[57] ABSTRACT

A fuel injection pump of a distributor injection pump type in which a quantity adjusting device is an annular slide that is axially displaceable on a fuel injection quantity regulator and which can additionally be rotated by a torque device. With the aid of this torque device, the control effectiveness of a second control edge, for instance in the form of a rectangular groove is controlled. The torque device is equipped with a clutch, which is embodied either via a spring or via a cam race. The torque device is actuated via an adjusting lever connected to the annular slide adjusting lever that serves to arbitrarily vary the fuel injection quantity at the direction of the driver of the motor vehicle.

23 Claims, 2 Drawing Sheets

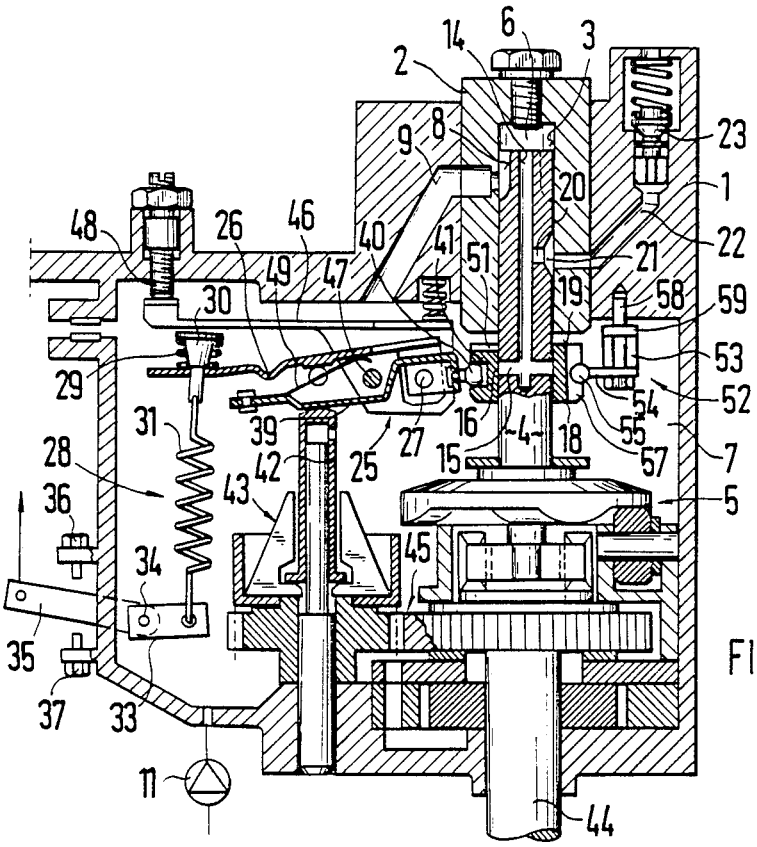
FIG.1
FIG.2
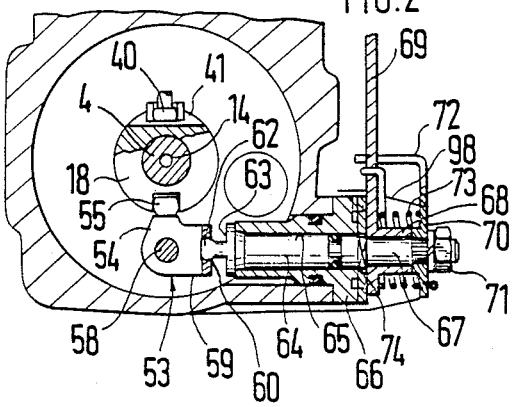
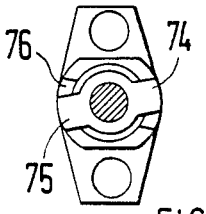
FIG.3

FUEL INJECTION PUMP FOR INTERNAL COMBUSTION ENGINES

BACKGROUND OF THE INVENTION

The invention is based on a fuel injection pump for internal combustion engines. In a fuel injection pump known from German Offenlegungsschrift No. 32 13 724, the pump piston has as its relief conduit an axial blind bore originating at the pump work chamber, from which bore a transverse conduit branches off to two first outlet openings. A radial conduit also branches off to a second outlet opening. This second outlet opening is offset with respect to the first outlet openings toward the pump drive side and cooperates with a radial bore, which is disposed in the annular slide and by way of which, serving as a conduit, a communication with the relief chamber can be established. In the known fuel injection pump the radial bore is disposed such that, at an annular slide position corresponding to the low-load operating range during the pump piston supply stroke, the second outlet opening is in communication with the radial bore, while in the full-load range, the second outlet opening does not come to communicate with the radial bore. This apparatus serves to allow only some of the supply strokes of the pump piston to be effective in the low-load range; accordingly, a plurality of radial bores are provided, distributed around the annular slide, so that only every other pump piston supply stroke, for instance, leads to a pressure buildup in the pump work chamber and hence to the injection of fuel. Correspondingly, only half of the cylinders of the internal combustion engine serve to drive the engine. This provision is meant to lower fuel consumption in the partial-load range.

A fuel injection pump of this type is also known from German Offenlegungsschrift No. 32 18 275, in which instead of the radial bores in the annular slide provided in the above-described known fuel injection pump, diametrically extending grooves originating at the end face of the annular slide are provided, which now, and together with the face end of the annular slide serving as a first control edge, cooperate with only a single outlet opening of the relief conduit. Thus the grooves have the second control edges for controlling the communication between the pump work chamber and the relief chamber prior to the coming into play of the first control edge. The annular slide here is not only axially displaceable on the pump piston as a function of the adjustment of a fuel injection quantity regulator, but is also rotatable by a torque device. By means of rotation, during the supply stroke of the pump piston, the outlet opening can be made to come into communication with one of the diametrically extending grooves in alternation, upon every supply stroke, or every other supply stroke, of the pump piston, depending on the number of grooves provided. Thus either the number of injections can be reduced by half, for example, similarly to what is known from the prior art described initially above, or the high-pressure supply of the fuel injection pump can be suppressed entirely. Furthermore, by reducing the width of the grooves, it is possible merely to throttle the outflow of fuel during a particular supply stroke, in order to reduce the fuel injection rate in the lower rpm range.

The quite-idle device that is thus realized has the effect that the engine can be operated while idling, for instance, with less combustion noise. For rotating the annular side, the known torque device is coupled rigidly to a crank, which is rotated during engine idling to cut off individual cylinders.

OBJECT AND SUMMARY OF THE INVENTION

The fuel injection pump according to the invention has the advantage over the prior art that the rotation of the annular slide for making the second control edge effective is effected automatically upon the arbitrary selection by the driver of the motor vehicle. In accordance with the desired torque or engine rpm at a given load, the adjusting lever of the fuel injection pump that supplies the engine with fuel is rotated. The torque device is advantageously coupled to this adjusting lever in such a way that the annular slide can be rotated only in a predetermined rpm range without restricting the rotatability of the adjusting lever.

In an advantageous feature of the invention, the pivoting device is coupled to the adjusting lever of the fuel injection pump via a torsion spring. By means of a stop range within which the shaft that moves the pivoting device can be rotated, the adjusting range can be adjusted in alternation and can also be easily changed afterward.

In another embodiment of the invention, the torque device is very simple, with few moving parts. In a further development of this feature, exact, smooth guidance, that is, without sticking, of the adjusting bolt that embodies the pivoting device is attained. In another advantageous feature of the invention, parts imperiled by wear, such as the restoring spring of the adjusting bolt, are disposed outside the fuel injection pump, where if they fail they do not threaten fuel injection pump operation to such an extent that fuel regulation failure could damage the engine.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a longitudinal section through a fuel injection pump, shown in simplified form, having a torque device for the annular slide;

FIG. 2 shows a first exemplary embodiment of the torque device, having a rotatable shaft and a bell crank, for rotating the annular slide;

FIG. 3 is a fragmentary view of the exemplary embodiment of FIG. 2, having stops to limit the range of rotation;

DESCRIPTION OF THE PREFERRED EMBODIMENTS

Figure 4:
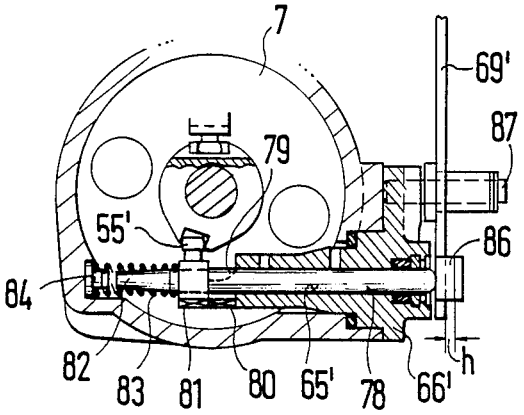
FIG. 4 shows a second exemplary embodiment of the invention having an adjusting bolt embodied as a pivoting device, which is kept in contact with an adjustable cam race by means of a restoring spring located inside the fuel injection pump.

A bushing 2 is disposed in a housing 1 of a fuel injection pump shown in cross section in FIG. 1. An inner bore 3 of bushing 2 forms a pump cylinder within which a pump piston 4 driven by a cam drive 5 executes a simultaneously reciprocating and rotating motion. On one face end, the pump piston encloses a pump work chamber 6 and the other end protrudes partway out of the inner bore 3 into a pump suction chamber 7, which is enclosed in the housing 1.

The pump work chamber 6 is supplied with fuel, via longitudinal grooves 8 disposed in the jacket face of the pump piston and via a suction bore 9 in the housing that originates at the pump suction chamber 7, the fuel passes radially through the bushing 2 and the suction bore within the housing 1 as long as the pump piston is executing its intake stroke or assumes its bottom dead center position. The pump suction chamber is supplied with fuel from a fuel tank, not shown here, via a feed pump 11. By means of a pressure control valve, not shown, the pressure is typically controlled in accordance with rpm in the suction chamber, so as to enable making an rpm-dependent injection adjustment, for example hydraulically, via a pressure control as a function of rpm. With increasing rpm, the stroke onset of the pump piston is adjusted to "early" in a known manner.

In the pump piston, a longitudinal conduit 14, which is embodied as a blind bore leads away from the pump work chamber 6 and serves as a relief conduit. Branching off from the relief conduit is a transverse bore 15, which leads to first outlet openings 16 on the circumference of the pump piston 4, into a region in which the pump piston protrudes into the suction chamber 7, which at the same time serves as a relief chamber for fuel that is put under high pressure in the pump work chamber 6. The outlet openings 16 are preferably located diametrically opposite one another, which results in a balanced hydraulic load on the pump piston. Disposed on the pump piston in this region is a quantity adjusting device in the form of an annular slide 18, which with the jacket face of its inner ring slides tightly on the pump piston. This annular slide is rotatably adjustable and axially displaceable, and with a first control edge 19, embodied by the jacket face and an upper face end, the annular slide controls the first outlet openings 16.

Also branching off from the relief conduit 14, which preferably extends coaxially with the pump piston axis, is a radial bore 20, which leads to a distributor opening 21 on the circumference of the pump piston. In the operating region of this distributor opening, a plurality of feed lines 22 branch off from the inner bore 3 in a radial plane, which are distributed on the circumference of the inner bore 3 in accordance with the number of cylinders of the associated engine that are to be supplied with fuel. The fuel feed lines lead via one valve 23 each, which is embodied in a known manner as a check valve or pressure relief valve, to the fuel injection locations, not shown. As soon as the suction bore 9 is closed by the jacket face of the pump piston, at the onset of the supply stroke of the pump piston following a corresponding rotation of the pump piston, the fuel located in the pump work chamber 6 is pumped to these injection locations via the relief conduit 14, the radial bore 20 and the distributor groove 21. This pumping is interrupted whenever the first outlet openings 16, in the course of the pump piston stroke, are opened by the control edge 19 and come into communication with the suction chamber 7. From that point on, the remaining fuel positively displaced by the pump piston is pumped only into the suction chamber. The higher the level at which the annular slide 18 is adjusted toward the pump work chamber, the greater the quantity of fuel pumped by the pump piston.

The fuel injection quantity regulator 25 provided for the adjustment of the annular slide has a tensioning lever 26, which is pivotable about a shaft 27, and is coupled at its lever arm end to a governor spring assembly 28. This assembly comprises an idling spring 29 disposed between the head of a coupling element 30 and the tensioning lever; the coupling element 30 is passed through an opening in the tensioning lever, and at its other end, remote from the head, it is connected to a main governor spring 31. The main governor spring 31, in turn, is suspended at one end from a pivot arm 33, which is adjustable with an adjusting lever 35, via a shaft 34 passed through the pump housing. The adjusting lever is arbitrarily actuatable between an adjustable full-load stop 36 and an adjustable idling stop 37 by a person operating it. For instance, the adjusting lever 35 is connected to the gas pedal, which the driver of the motor vehicle equipped with the engine and fuel injection pump actuates in accordance with the torque he selects. Instead of the simple helical spring shown here as the main governor spring, it is naturally also possible to use other governor spring assemblies that are of the multi-stage and/or pre-stressed type.

A starting or governor lever 39 is also pivotable about the shaft 27; it is two-armed, with one arm, including a ball head 40 which engages a transverse groove 41 in the annular slide extending in a radial plane to the annular slide by which it is coupled to the annular slide. The other arm of the starting lever has a leaf spring 49, which is braced against the tensioning lever 26 and serves as the starting spring thereby forcing the arm from the tensioning lever 26. Acting upon this particular lever arm of the starting lever 39 is the final control element 42 of an rpm transducer in the form of a flyweight control assembly 43 of a known type, which is driven synchronously with the drive shaft 44 of the fuel injection pump, via a gear train 45. With increasing rpm, the final control element 42, along with the starting lever 39 and the annular slide 18, is accordingly displaced counter to the force of the starting spring 49, until the starting spring comes to rest on the tensioning lever 26. In the course of this movement, the annular slide is adjusted away from a highest position, nearest the pump work chamber and corresponding to a starting quantity setting, toward the pump piston drive side, thus reducing the increased starting quantity. Once the starting lever comes to rest on the tensioning lever, both levers become pivotable counter to the force of the idling spring 29, until the main governor spring 31 comes into action, adjacent the idling range. Depending upon the embodiment of the main governor spring as either a variable- speed governor spring or a miminim-maximum-speed governor spring, the tensioning lever is moved onward upon reaching the set rpm, and the annular slide 18 is displaced in order to reduce the injection quantity. In other words, a greater or lesser quantity of fuel is injected at a given rpm, depending on the position of the adjusting lever 35.

For adjustment, the shaft 27 is supported on an adjusting lever 46, which is pivotable about a shaft 47 attached to the housing and is kept in contact with an adjustable stop 48 by a spring acting upon one end.

To the extent described thus far, the fuel injection pump is equivalent to a standard, known version. In addition, a rectangular groove 51 is now provided on the face end of the annular slide 18 oriented toward the pump work chamber 6; similarly to the subject of German Offenlegungsschrift No. 32 18 275 discussed initially above, this groove 51 may be embodied either as a throttling groove having a throttling cross section, or as a cutoff groove having a correspondingly larger cross section. One of the limiting edges of the rectangular groove makes a second control edge available, which cooperates with the outlet openings 16 and opens them earlier than does the first control edge 19. By rotating the annular slide 18, this groove 51 can now be put into its operating position, so that it comes into communication with the outlet opening 16 during the supply stroke of the pump, or into the turned-off position, such that it is inoperative for control purposes and the outlet opening 16 is opened toward the relief chamber 7 only by the control edge 19. To this end, a torque device 52 is provided, which has a pivoting device 53 in the form of a bell crank, on one lever arm 54 a ball head 55 is integrally formed; as a sliding element. The ball head engages a longitudinal groove 47 on the slide 18 by which radial adjustment is accomplished. The lateral limiting faces of the longitudinal groove, which extends axially parallel, represent guide faces for the ball head 55 and permit an axial adjustment of the annular slide 18 by the fuel injection quantity regulator 25, without rotation of the annular slide at the same time. Naturally a technological equivalent can be provided in the form of a claw on the lever arm 54 and a guide nose or guide gudgeon on the annular slide. Depending on the embodiment, the guide faces are then located on the guide nose or guide rib, or on the claw.

The bell crank 53 is supported on a shaft 58, which is connected to the housing and has as its other lever arm a U-shaped strap 59, which is additionally supported on its end on the shaft 58, as shown in FIG. 2. An actuating arm 62 that is mounted eccentrically on the face end 63 of a shaft 64 engages a recess 60 of the U-shaped strap 59. The shaft 64 is guided in an inner bore 65 of a bushing 66, which is inserted tightly from the outside into the housing 1 of the fuel injection pump. On its end that protrudes outward, the shaft 64 has a diameter reduction 67, on which a hub 68 of an adjusting lever 69 is supported. The adjusting lever is secured in the axial direction toward the outside by a form-fitting lever 70, which is retained by a nut 71 that is screwed onto the end of the shaft 64. One end of a pre-stressed torsion spring 73 is suspended from this lever, which is accordingly fixed to the shaft 64 so that the lever and shaft do not rotate relative to one another; the other end of the torsion spring 73 is suspended from the adjusting lever 69. Because of its initial stress, the torsion spring keeps the adjusting lever 69 in contact with the arm 72 of the lever 70 and thus effects coupling of the adjusting lever 69 to the shaft 64. A disk 74, the form of which is more clearly shown in the plan view of FIG. 3, is mounted between the diameter reduction 67 and the shaft. This disk 74 has two arms 76, which engage a recess 76 that defines a certain rotational angle range. The recess 76 is located on the face end of the outer portion of the bushing 66. By means of the disk 74 in combination with the recess 75 and the arm 75 of the disk, the shaft 64 is accordingly rotatable only within the angular range defined by the recess 76. It is rotated via the adjusting lever 69, which by means of the torsion spring 73 and the lever 70 is coupled to the shaft 64 but which is capable of moving through a very much larger rotational angle than the shaft 64, because the spring 73 allows it to overrun, or move freely, after lifting from the arm 72. If the shaft 64 rotates, then the bell crank 53 is moved, via the actuating arm 62, by this particular rotational amount, taking the gear ratios into account. The annular slide 18 is then correspondingly adjusted radially by a defined amount as well. The initial position of the adjusting movement can be set by adjustment of the bushing 66.

For the adjustment of the annular slide, the adjusting lever 69 is coupled to the adjusting lever 35 and can be moved synchronously by the adjusting lever 35. The result is an automatic adjustment of the annular slide 18 as a function of the load range indicated by the adjusting lever 35. Depending on the intended use of the second control groove of the groove 51, it is then possible, with a restriction to the sliding range, for instance, to divert a throttled fuel bypass flow from the pump work chamber 6 whenever the outlet opening 16 comes to communicate with the rectangular groove 51. Correspondingly, the pumping rate of the pump piston to the injection locations is then reduced during idling, and quiet idling can be attained with the quiet-idle device embodied in this way. At higher-load positions of the adjusting lever 35, the rectangular groove 51 or rectangular grooves can then be rotated into the turned-off position, via the adjusting lever 69 of the torsion device 52. In a known manner, the grooves are disposed on the annular slide in accordance with the number of pump piston pumping strokes, so that for example when there are two outlet openings 16 the number of grooves 51 can be reduced by half. This is possible, however, only if the number of pumping strokes is an integer; in the case of 5-cylinder injection pumps, for instance, there must be no more than a single outlet opening 16, and five rectangular grooves 51 must correspondingly be provided. With the torsion device described, however, other control principles that are controlled with a rotation of the annular slide can be attained. In that event, the second control edge can also be provided in some other manner than that shown. A plurality of control openings, offset from one another in the rotational or axial direction, on the pump piston or annular slide can then be provided, for which the control effectiveness is varied by rotating the annular slide.

Figure 5:
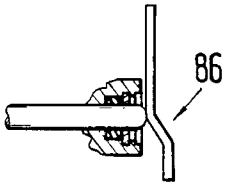
FIG. 5 is a fragmentary view of the exemplary embodiment of FIG. 4.

FIG. 4 shows a second exemplary embodiment, which in principle is similar to the exemplary embodiment of FIG. 2. Here, however, the ball head 55', which corresponds to the ball head 55 of FIG. 2, is secured to an adjusting bolt 78 that is tightly guided in an inner bore 65' of a bushing 66' inserted into the pump housing. The adjusting bolt 68 is located transversely to the pump piston axis and at right angles to a plane within which the pump piston axis is located. On the end protruding into the pump interior 7, toward the pump piston axis, the bushing 66' has a lateral opening 79, and diametrically opposite this opening, in the wall, it has a longitudinal slit 80. The end of the adjusting bolt 78 protruding into the pump suction chamber 7 has the head 55', which protrudes through the opening 79. Also engaging the slit 80 is a guide nose 81, by way of which the adjusting bolt 78 is secured against twisting. Adjoining the guide nose, the adjusting bolt 78 has a centering gudgeon 82, onto which a restoring spring 83, in the form of a spiral compression spring, is slipped; the other end of this spring 83 is supported on a spring plate 84 that is connected to the housing. By means of this spring, the adjusting bolt is held with its end located outside the injection pump on a cam race 86, which in the embodiment shown here is formed integrally on the adjusting lever 69'. The adjusting lever 69' is pivotable in a radial plane to the axis of the adjusting bolt and has a right-angle bend serving as the cam race 86. Depending on the pivot angle of the adjusting lever 69', which is pivotable about a shaft 87 attached to the housing, the adjusting bolt 78 is displaced inward or outward in the axial direction by the amount h. FIG. 5 shows the cam race 86 in a section offset by 90° from that of FIG. 4. In this exemplary embodiment, as in FIG. 2, O-rings are possible as seals. The adjusting lever 69' can now be coupled to the adjusting lever 35, in an analogous manner to the exemplary embodiment of FIG. 2. By means of the right-angle bend, the adjusting lever 69' can be rotated an arbitrary distance without displacing the adjusting bolt 78 beyond the intended extent. By interposing spacer rings in the bearing of the adjusting lever 69', a desired initial position of the adjusting bolt 78 can easily be established.

Instead of the above-described actuation of the adjusting bolt 78 of FIGS. 4 and 5, the adjusting bolt 78 can also be actuated by a lever 88, which is supported on a shaft 89 secured on the outside of the fuel injection pump housing and acts with one lever arm 90 axially resting upon the adjusting bolt. The other lever arm 91 is in contact with a cam race 92, this contact being assured by the restoring spring 83. The cam race 92 is connected to the adjusting lever 35 and can for instance be embodied analogously to the embodiment of FIGS. 4 and 5. In practical terms, this is a technological equivalent to the embodiment of FIG. 4.

Figure 6:
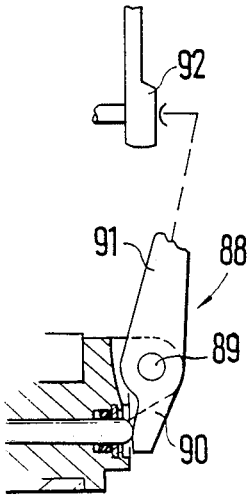
FIG. 6 shows a third exemplary embodiment, as a modification of the exemplary embodiment of FIG. 4.
Figure 7:
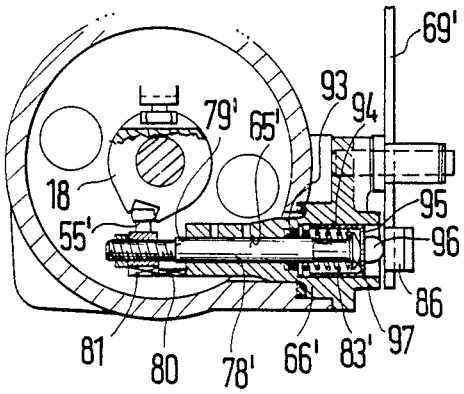
FIG. 7 shows a fourth exemplary embodiment, as a further modification of the exemplary embodiment of FIG. 4.

A fourth exemplary embodiment is shown in FIG. 7. Here, in a modification of the exemplary embodiment of FIG. 4, the adjusting bolt 78' is again supported in the bushing 66'. The head 55' is again secured at the end of the adjusting bolt 78' and protrudes through an opening 79' toward the pump piston axis and is coupled with the annular slide 18. The adjusting bolt 78' is again guided by the nose 81 in the slit 80. Deviating from the embodiment of FIG. 4, the restoring spring 83' is now disposed on the other end of the adjusting bolt 78'. To this end, the inner bore 65' is changed, after the seal 93, into a bore segment 94 of larger diameter, in which a cup 95 is guided. The outside of the bottom of the cup is provided with a spherical element 96, which comes to rest on the cam race 86 of the adjusting lever 69'. The end of the adjusting bolt 78' comes to rest on the inside of the cup bottom. The end of the adjusting bolt is provided with a head 97; the restoring spring 83' is supported between this head and the bushing, at the transition between the inner bore 93 and the bore segment 94, and keeps the adjusting bolt 78' in contact with the cup 95. In this exemplary embodiment, the adjusting bolt 78' is in principle moved in the same manner as the adjusting bolt 78 of FIG. 4. Once again, a variant in its actuation is possible, as shown in FIG. 6. Advantageously, the restoring spring 83' is now located outside the interior of the fuel injection pump, so that in the event of spring breakage, for example, no elements that could cause damage can get into the interior of the fuel injection pump, which would be dangerous in such a case because regulation could be blocked or that essential parts might be destroyed. The spring 83' is also accommodated in a protected manner by being encapsulated by the cup 95. A similar protective device for the exemplary embodiment of FIG. 4, for example, in which the spring is also located outside the housing, can be provided in the form of a capsule 97 that is held on the lever 70 and encompasses both the end of the bushing 66 and the torsion spring 93. This embodiment again has the advantage that elements that are vulnerable to breakage are located outside the fuel injection pump. However, this version according to FIG. 2 has the disadvantage, as compared with the version of FIGS. 4 and 7, of having more moving parts, which must be adjusted and assembled and which furthermore entail greater transmission play.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel injection pump for internal combustion engines having a pump cylinder, a pump piston (4) simultaneously reciprocating and rotating in said pump cylinder (3) which serves as a distributor for the pumped fuel to feed a plurality of fuel injection locations, the pump piston defining a pump work chamber (6) in the pump cylinder, a relief conduit in said piston connecting said pump work chamber to an outlet on said pump piston, an annular slide on said pump piston for varying the fuel injection quantity pumped by the pump piston by controlling said outlet (16) on the pump piston circumference of said relief conduit (14), said relief conduit in the pump piston leading from the pump work chamber (6) to a relief chamber (7), by means of said annular slide (18), said annular slide is axially displaceable on the pump piston, a fuel injection quantity regulator (25) inside the relief chamber for controlling said said annular slide via a governor lever (39), said annular slide (18) having a first control edge (19) located in a plane perpendicular to the piston axis, a second control edge (51) controlling said outlet arranged relative to said first control edge by which communication of the pump work chamber (6) with the relief chamber (7) can be established, whereas effectiveness of said second control edge can be changed or stopped by changing the rotational position of said annular slide, said quantity regulator including a first coupling device located between the annular slide (18) and the governor lever (39), said first coupling device comprising first guide faces located in a plane perpendicular to the pump piston axis, said first coupling device including a coupling element (40) guided on said first guide faces which allows a rotation of said annular slide without an axial change in stroke of the first control edge (19), a second coupling device, located between the annular slide (18) and a pivoting device (53) of a torque device (52) for adjusting a rotational position of the annular slide, said second coupling device comprising a groove including second guide faces (57) extending in a direction of the pump piston axis which allows an axial change in stroke without rotation of the annular slide, a sliding element guided along said second guide faces, an adjusting lever (35) connected with said fuel injection quantity regulator of the fuel injection pump and moveable between an idling stop (37) and a full load stop (36), said adjusting lever serves to input a desired torque at the fuel injection quantity regulator (25), adjusting means for adjusting said second coupling device, said adjusting means being linked to said adjusting lever (35) which, upon a pivot movement of said adjusting lever over a preset pivot angle beginning at said idling stop, a rotation of the annular slide (18) is effected and in a subsequent pivot range of said adjusting lever the rotational position of said annular slide reached at an end of said preset pivot angle is retained.

2. A fuel injection pump as defined by claim 1, in which said adjusting means includes a shaft, an adjusting lever and a spring disposed outside the pump housing and operative relative to said shaft, said adjusting lever is coupled yieldingly to said adjusting lever (35) of the fuel injection pump, wherein the shaft is rotatable only in a predetermined angular range defined by stops.

3. A fuel injection pump as defined by claim 1, which includes a cam race (86) operative by said adjusting means coupled to the adjusting lever (35).

4. A fuel injection pump as defined by claim 1, in which said adjusting means includes a restoring spring and a lever (88) with a cam race which are moved by the adjusting lever (35) of the fuel injection pump.

5. A fuel injection pump as defined by claim 3, in which said adjusting means includes an adjusting bolt (78, 78'), which is guided tightly outward, out of the housing of the fuel injection pump, in a bore (65').

6. A fuel injection pump as defined by claim 4, in which said adjusting means includes an adjusting bolt (78, 78'), which is guided tightly outward, out of the housing of the fuel injection pump, in a bore (65').

7. A fuel injection pump as defined by claim 5, in which said adjusting means includes an anti-torsion device (80, 81) and on one end which protrudes into the relief chamber (7) a sliding element (55, 55'), which engages said guide faces (57) that are disposed on the annular slide (18).

8. A fuel injection pump as defined by claim 6, in which said adjusting means includes an anti-torsion device (80, 81) and on one end which protrudes into the relief chamber (7) and a sliding element (55, 55'), which engages said guide faces (57) that are disposed on the annular slide (18).

9. A fuel injection pump as defined by claim 7, in which said inner end of said adjusting bolt includes the sliding element and said adjusting bolt (78) is acted upon on its inner end by a restoring spring (83) that is supported integrally against the housing in the relief chamber (7).

10. A fuel injection pump as defined in claim 8, in which said inner end of said adjusting bolt includes the sliding element and said adjusting bolt (78) is acted upon on its inner end by a restoring spring (83) that is supported integrally against the housing in the relief chamber (7).

11. A fuel injection pump as defined by claim 7, in which said restoring spring (83') that is supported between the adjusting bolt (78') and the housing (1) is disposed in a bore segment (94) of enlarged diameter that adjoins a bore (65') toward the outside.

12. A fuel injection pump as defined in claim 9, in which said restoring spring (83') that is supported between the adjusting bolt (78') and the housing (1) is disposed in a bore segment (94) of englarged diameter that adjoins a bore (65') toward the outside.

13. A fuel injection pump as defined in claim 11, in which said adjusting bolt (78') is pressed with its outer end against a cup surrounding said restoring spring (83') and is guided in said enlarged bore segment (94), in which said cup rests via a spherical element (96) on the cam race (86) of the adjusting lever (69')

14. A fuel injection pump as defined by claim 12, in which said adjusting bolt (78') is pressed with its outer end against a cup surrounding said restoring spring (83') and is guided in said enlarged bore segment (94), in which said cup rests via a spherical element (96) on the cam race (86) of the adjusting lever (69').

15. A fuel injection pump as defined by claim 5, in which said cam race is embodied on an arm of the adjusting lever (69') that moves in a plane radial to the adjusting bolt axis and is embodied as a right-angle bend of said arm.

16. A fuel injection pump as defined by claim 6, in which said cam race is embodied on an arm of the adjusting lever (69') that moves in a plane radial to the adjusting bolt axis and is embodied as a right-angle bend of said arm.

17. A fuel injection pump as defined by claim 7, in which said cam race is embodied on an arm of the adjusting lever (69') that moves in a plane radial to the adjusting bolt axis and is embodied as a right-angle bend of said arm.

18. A fuel injection pump as defined by claim 9, in which said cam race is embodied on an arm of the adjusting lever (69') that moves in a plane radial to the adjusting bolt axis and is embodied as a right-angle end of said arm.

19. A fuel injection pump as defined by claim 10, in which said cam race is embodied on an arm of the adjusting lever (69') that moves in a plane radial to the adjusting bolt axis and is embodied as a right-angle bend of said arm.

20. A fuel injection pump as defined by claim 11, in which said cam race is embodied on an arm of the adjusting lever (69') that moves in a plane a radial to the adjusting bolt axis and is embodied as a right-angle bend of said arm.

21. A fuel injection pump as defined by claim 12, in which said cam race is embodied on an arm of the adjusting lever (69') that moves in a plane radial to the adjusting bolt axis and is embodied as a right-angle bend of said arm.

22. A fuel injection pump as defined by claim 13, in which said cam race is embodied on an arm of the adjusting lever (69') that moves in a plane radial to the adjusting bolt axis and is embodied as a right-angle bend of said arm.

23. A fuel injection pump as defined in claim 14, in which said cam race is embodied on an arm of the adjusting lever (69') that moves in a plane radial to the adjusting bolt axis and is embodied as a right-angle bend of said arm.

* * * * *